US007145430B2

(12) United States Patent
Peinsipp et al.

(10) Patent No.: US 7,145,430 B2
(45) Date of Patent: Dec. 5, 2006

(54) ELECTRICAL COMPONENT AND METHOD FOR MAKING THE COMPONENT

(75) Inventors: Roland Peinsipp, Graz (AT); Franz Schrank, Raaba (AT)

(73) Assignee: Epcos AG, Munich (DE)

( * ) Notice: Subject to any disclaimer, the term of this patent is extended or adjusted under 35 U.S.C. 154(b) by 0 days.

(21) Appl. No.: 10/363,275

(22) PCT Filed: Aug. 2, 2001

(86) PCT No.: PCT/DE01/02931

§ 371 (c)(1),
(2), (4) Date: May 30, 2003

(87) PCT Pub. No.: WO02/19348

PCT Pub. Date: Mar. 7, 2002

(65) Prior Publication Data

US 2004/0026106 A1 Feb. 12, 2004

(30) Foreign Application Priority Data

Aug. 30, 2000 (DE) ..... 100 42 636

(51) Int. Cl.
*H01C 7/10* (2006.01)

(52) U.S. Cl. ..... 338/22 R; 338/257

(58) Field of Classification Search ..... 338/22 SD, 338/25, 21, 256, 257
See application file for complete search history.

(56) References Cited

U.S. PATENT DOCUMENTS

| | | | | |
|---|---|---|---|---|
| 2,741,687 | A * | 4/1956 | Toppari | 428/368 |
| 2,883,502 | A * | 4/1959 | Rudner | 338/330 |
| 2,885,523 | A * | 5/1959 | Wright et al. | 338/257 |
| 3,562,007 | A * | 2/1971 | Bockstie, Jr. | 428/215 |
| 3,599,139 | A * | 8/1971 | Low | 338/2 |
| 3,655,610 | A * | 4/1972 | Vasta | 523/416 |
| 3,666,551 | A * | 5/1972 | Bockstie, Jr. | 428/327 |
| 3,793,716 | A * | 2/1974 | Smith-Johannsen | 29/611 |
| 3,824,328 | A | 7/1974 | Ting et al. | |
| 4,001,655 | A | 1/1977 | Voyles et al. | |
| 4,959,426 | A | 9/1990 | Re et al. | |
| 5,321,386 | A * | 6/1994 | Ishiguro | 338/269 |
| 6,025,556 | A | 2/2000 | Yoshimura et al. | |

FOREIGN PATENT DOCUMENTS

| | | | | |
|---|---|---|---|---|
| DE | 25 00 789 | | 7/1975 | |
| DE | 23 51 956 | | 12/1982 | |
| DE | 37 89 365 | | 9/1994 | |
| DE | 197 21 101 | | 12/1997 | |
| DE | 198 14 388 | | 10/1998 | |
| DE | 198 51 869 | | 7/2000 | |
| EP | 0322339 | * | 6/1989 | |
| JP | 1-235203 | * | 9/1989 | 338/25 |

* cited by examiner

*Primary Examiner*—Tu Hoang
(74) *Attorney, Agent, or Firm*—Schiff Hardin LLP

(57) ABSTRACT

An electrical component which has a base body that comprises a ceramic material and at least two contact regions arranged on the base body to which terminal elements are secured, is enveloped by a protective layer containing organic constituents, and has an intermediate layer that is arranged between the base body and the protective layer and is composed of an intermediate layer material that is both hydrophobic as well as lipophobic. The intermediate layer can be advantageously composed of a fluoropolymer which is manufactured by immersing the base body into a fluid that dissolves this polymer. The moisture stability of the electrical component is critically improved by the intermediate layer. The components are particularly employed as hot-carrier thermistor temperature sensors.

19 Claims, 1 Drawing Sheet

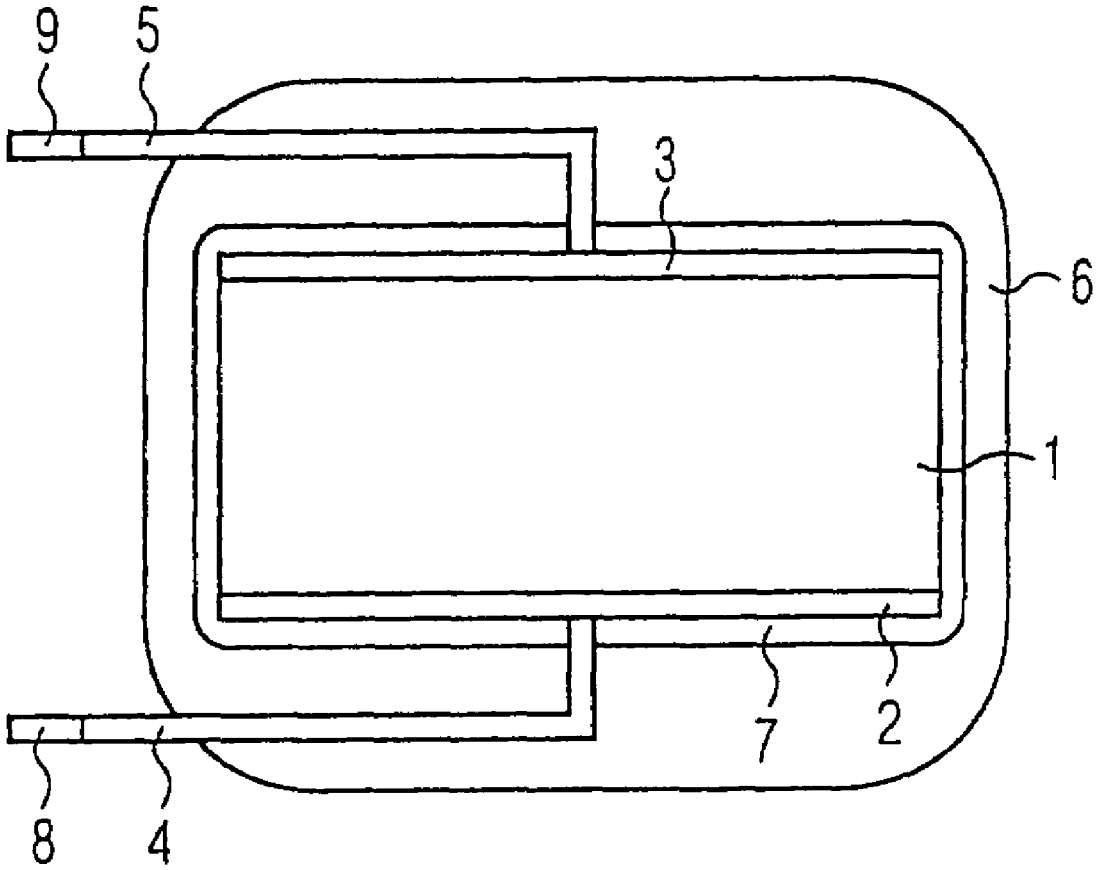
9
5
3
6
1
7
2
8
4

ELECTRICAL COMPONENT AND METHOD FOR MAKING THE COMPONENT

BACKGROUND OF THE INVENTION

The invention is directed to an electrical component having a base body that comprises a ceramic material and having at least two contact regions arranged in the base body to which terminal elements are secured. The component is enveloped with a protective layer containing organic constituents. The invention is also directed to a method for the manufacture of the electrical component.

DE 198 51 869 A1 discloses electrical components of the species initially cited that represent a hot-carrier thermistor temperature sensor composed of a disk-shaped ceramic material. In addition to leads attached to the material, the temperature sensor comprises an epoxy resin envelope that contains an auxiliary constituent with hydrophobic properties.

The known electrical component has the disadvantage that it is sensitive to moisture. Even though it has a hydrophobic envelope of epoxy resin that, for example, can be produced by immersion, outages can occur under the influence of moisture and/or water as a consequence of migration effects. Due to the adjacent voltage employed in the operation of the component, namely, there is a difference in potential between the two electrical poles of the ceramic element to which the leads are secured. When, under the use conditions in a humid environment, a closed water film forms between the electrodes, then a material transport starts (mediated by silver, tin and lead of the solder employed when soldering the leads on) from the anode to the cathode. Metallic films are formed that are capable of functioning similar to interconnects on the surface of the ceramic. The resistance of the sensor therefore decreases so greatly that a total outage of the hot-carrier thermistor temperature sensor can even occur under certain circumstance due to a short. Such hot-carrier thermistor temperature sensors can therefore only be provided for areas of employment wherein a moistening or, respectively, an influence of water at the temperature sensor does not occur.

In order to avoid the described problem, it is known from the Prior Art to provide the hot-carrier thermistor temperature sensor with a glass envelope. Given this design, however, no insulated leads can be utilized due to the high process temperatures. Moreover, there is a risk here that damage due to electrochemical corrosion of the wires or migration via the glass member can occur given corresponding use conditions.

SUMMARY OF THE INVENTION

It is therefore an object of the present invention to specify a component of the species initially cited that exhibits a long service life even under the influence of moisture.

This object is inventively achieved by an electrical component having a base body that comprises a ceramic material and has at least two contact regions arranged in the base body to which terminal elements are secured, and this component is enveloped with a protective layer containing organic constituents, and has an intermediate layer that is arranged between the base body and the protective layer and is composed of an intermediate layer material that is both hydrophobic as well as lipophobic.

The component has the advantage that, due to the intermediate layer of hydrophobic material, the penetration of moisture from the outside onto the surface of the base body can be effectively reduced at those locations at which the base body is covered by the intermediate layer.

In addition, the inventive component has the advantage that, due to the lipophobic material property of the intermediate layer, this is compatible with the protective layer surrounding the base body. In particular, no chemical reaction occurs between the protective layer and the intermediate layer. As a result thereof, a migration of constituents of the protective layer through the intermediate layer onto the surface of the base body can also be effectively prevented, including the damage that becomes possible as a result thereof.

It is especially advantageous when the intermediate layer tightly surrounds the base body of the component, so that access of moisture is inhibited at the entire surface of the base body.

In addition, a component is especially advantageous wherein the intermediate layer material is soluble in a fluid with which the base body can be moistened.

Such a component has the advantage that the intermediate layer can be produced in a simple way by immersing the base body into a solution that contains the fluid and the intermediate layer material dissolved therein.

As a result thereof, the base body can be moistened by the fluid, and the advantage derives that the base body can be unproblematically covered with the intermediate layer so that the intermediate layer tightly surrounds the base body.

In addition, a component is especially advantageous wherein the thickness of the intermediate layer amounts to at least 1.5 μm at its thinnest location. This minimum thickness guarantees that the access of moisture to the base body is inhibited at all locations at which the intermediate layer is arranged on the base body.

For example, a fluoropolymer is a material suitable for the intermediate layer that exhibits the required properties. This is thereby a matter of a perfluoridated carbon framework structure. The carbon framework structure can thereby be constructed of chains, of connected ring systems or of a mixed form of the two. In particular, an intermediate layer material is especially advantageous that is formed of condensed perfluoridated ring systems. Further, polyethers are also employable that comprise no C—C chains but C—O—C chains. The molecular weight of the polymer advantageously lies above 1000 g/mol. A fluoropolymer is also advantageous that is soluble in specific solvents, preferably in perfluoridated alkanes.

The fluorine-containing polymer can also have the advantage that it exhibits a soft, wax-like consistency that can have a favorable influence on the thermal fatigue resistance of the layer and of the entire component as well.

The protective layer of the component can thereby be advantageously composed of a material that is electrically insulating and is simultaneously suited for protecting the intermediate layer against abrasion. A protective layer of this material has the advantage that it protects the component from electrical shorts from the outside. In addition, the protective layer has the advantage that it can effectively protect the intermediate layer against mechanical damage due, for example, to abrasion, so that the intermediate layer can be composed of a fluoropolymer that can have a low mechanical resistance and exhibit a soft, wax-like consistency.

A protective layer that exhibits the demanded properties with respect to the electrical insulation and the protection of the intermediate layer is advantageously composed of epoxy resin, silicone or urethane.

The invention also specifies a method for the manufacture of an electrical component that is based on a base body that comprises a ceramic material. The base body thereby comprises at least two contact regions to which terminal elements are secured.

The method comprises the following steps:

In a first step, the base body is immersed into a solution that contains a fluid that wets the base body and a hydrophobic and lipophobic intermediate layer material dissolved in this fluid. Advantageously, the base body is thereby immersed into the solution so that the base body is situated entirely within the solution.

In a further step, the base body is removed from the solution so that a part of the solution remains adhering thereto as a film that completely envelopes the base body.

In a further step, the fluid contained in the film is removed by evaporation, and the intermediate layer occurs as a result of the evaporation.

In a following step, the protective layer is applied onto the intermediate layer. The protective layer can also be advantageously applied by immersing the base body into a corresponding solution or, respectively, fluid.

The inventive method for manufacturing the electrical component has the advantage that it is especially simple to realize since the base body of the component merely has to be immersed into a solution for the application of the intermediate layer. In addition, the method has the advantage that the manufacture of the intermediate layer from the solution occurs by evaporation of fluid in a fluid film. Such an evaporation requires no further technical measures other than simple storing of the component at, for example, room temperature and can thus be cost-beneficially realized.

The method can be especially advantageously implemented in that the viscosity of the solution into which the base body is immersed is set by means of a suitable selection of the content of the intermediate layer material in the solution that the film adhering to the base body leads to an intermediate layer that is at least 1.5 μm thick at the thinnest location. This measure assures that the intermediate layer comprises the required minimum thickness at every location.

A perfluoro alkane in which a fluoropolymer, which is suitable as an intermediate layer material, is soluble can be advantageously employed as the fluid that contains the intermediate layer material in a dissolved form.

The invention is explained in greater detail below on the basis of an exemplary embodiment and the appertaining FIGURE.

BRIEF DESCRIPTION OF THE DRAWING

The FIGURE shows a schematic cross-section of an inventive electrical component by way of example.

DESCRIPTION OF THE PREFERRED EMBODIMENTS

The FIGURE shows an electrical component having a base body 1 that can be composed of a polycrystalline ceramic of the spinel type, particularly the Mn—Ni spinel type, and that can, over and above this, contain additional dopings or, respectively, secondary constituents. Additionally, ceramics are also conceivable that are composed of other principal constituents. The aforementioned ceramic of the Mn—Ni spinel type is usually employed as the base body 1 for hot-carrier thermistor temperature sensors. It is especially important precisely in such hot-carrier thermistor temperature sensors that the base body exhibit a stable electrical resistance that is not changed due to the influence of moisture.

The FIGURE also shows a first contact region 2 and a second contact region 3 that are applied to the upper side or, respectively, underside of the base body 1. These contact regions can, for example, be manufactured by means of a silver stoving paste. A first terminal element 4 that, for example, can be a wire provided with an electrical insulation is secured to the first contact region 2. The fastening of such a wire to the first contact region 2 preferably occurs by soldering. In the same way as at the first contact region 2, a second terminal element 5 in the form of an insulated wire that is soldered on and is secured to the second contact region 3.

The base body 1 is enveloped by an intermediate layer 7 that is applied by immersing the base body 1 into a solution of a fluoropolymer. This fluoropolymer is constructed of multi-cyclic monomer units and its molecular weight amounts to approximately 2000 g/mol. The concentration of the solution of this polymer lies between 1% and 30%. The viscosity of the solution can be set by the concentration of the solution, so that the thickness of the intermediate layer 7 is also defined as a result thereof. For example, easily obtainable perfluoro alkanes, particularly perfluoro hexane or perfluoro octane, are suitable as a solvent.

After the solvent is dried off, the envelope is enveloped with a two-component epoxy in an immersion process. The protective layer 6 is formed as a result of this step.

It should be noted with respect to the intermediate layer 7 that, due to the application of the layer in an immersion process, a largely uniform layer thickness as shown in the FIGURE cannot be achieved. On the contrary, the layer at the edges of the base body 1 will be significantly thinner than, for example, between the contact regions 2, 3. In the exemplary embodiment described here, an intermediate layer 7 was produced that can comprise a layer thickness of less than 2 μm at the edges of the base body 1 and thicknesses up to 5 μm at other locations.

The protective layer 6 is applied by means of the described immersion process and it comprises a layer thickness between 100 μm and 1000 μm. That stated for the intermediate layer 7 applies to the protective layer 6 with respect to its thickness. All standard envelope materials, for example on the basis of epoxy resin, that are electrically insulating and exhibit a minimum resistance to the formation of cracks come into consideration as the protective layer 6. In addition to epoxy resin, polyurethane resin or silicone lacquer also come into consideration. In addition to being applied in the immersion process, the protective layer 6 can also be applied with some other method, for example with a powder coating method.

When manufacturing the intermediate layer 7 or, respectively, the protective layer 6, the base body 1 is preferably immersed into the corresponding fluid so that end sections 8, 9 of the terminal elements 4, 5 remain uncoated and can thus be employed as electrical contacts for connecting the component in a circuit.

A temperature sensor manufactured according to the described exemplary embodiment was tested for water resistance under various test conditions. For that purpose, for example, a storing in water at a temperature of 80° and an adjacent d.c. voltage of 3 V was implemented over 2000 hours. The temperature sensor passed this test without any change in the electrical resistance.

Other tests that were implemented, which contain a succession of various types of loads such as, for example:

thermal cycling, followed by vibration, subsequent storing in water at a temperature of 80° and an adjacent d.c. voltage of 3 V, followed by electrical loading with a heating capacity of 60 mW, subsequent cyclical moistening or, respectively, ice-coating upon application of an electrical voltage, as well as following aging at a temperature of 155° C. and subsequent storing of the temperature sensor in water at 80° C. upon application of a voltage of 3 V. The temperature sensor also passed this sequence of stresses without damage. The tests were passed without the temperature sensor having changed in electrical resistance.

The same tests were implemented with a similar temperature sensor but without the intermediate layer 7. 100% of such temperature sensors had already failed after fewer than 100 hours given storing in water at 80° C. upon application of an electrical voltage of 3 V.

The invention is not limited to the illustrated exemplary embodiment but is defined in its broadest form by the claims.

The invention claimed is:

1. An electrical component comprising:

a base body of a ceramic material, said base body having two contact regions connected to terminal elements, the terminal elements forming electrical poles enabling employment of a voltage on the ceramic material;

an intermediate layer covering said base body and contact regions; and a protective layer on the intermediate layer, the intermediate layer having an interface with the protective layer, the intermediate layer consisting of a material selected from the group consisting of fluoropolymer and polyether, and the protective layer containing an organic constituent, wherein the intermediate layer is in direct contact with the base body.

2. A component according to claim 1, wherein the intermediate layer material is soluble in a fluid with which the base body can be moistened.

3. A component according to claim 2, wherein the intermediate layer is produced by immersing the base body into a solution that contains a fluid in which the intermediate layer material is dissolved.

4. A component according to claim 3, wherein the thickness of the intermediate layer amounts to at least 1.5 μm at the thinnest location.

5. A component according to claim 3, wherein the protective layer is composed of material that is electrically insulating and is suitable for protecting the intermediate layer against abrasion.

6. A component according to claim 5, wherein the protective layer is selected from a group consisting of epoxy resin, silicone and polyurethane.

7. A component according to claim 1, wherein the intermediate layer amounts to at least 1.5 μm at the thinnest location.

8. A component according to claim 1, wherein the protective layer is a material that is electrically insulating and suitable for protecting the intermediate layers against abrasion.

9. A component according to claim 8, wherein the protective layer is selected from a group consisting of epoxy resin, silicone and polyurethane.

10. A component according to claim 2, wherein the protective layer is selected from a group consisting of epoxy resin, silicone and polyurethane.

11. An electrical component according to claim 1, wherein the intermediate layer has a thickness which is at the most 5 μm thick.

12. An electrical thermistor component comprising:

a base body of a ceramic hot-carrier thermistor material, said base body having two contact regions connected to terminal elements;

an intermediate layer covering said base body and contact regions; and a protective layer forming an interface between the intermediate layer and the protective layer, the intermediate layer consisting of a material selected from the group consisting of a fluoropolymer and a polyether, and the protective layer containing an organic constituent, wherein the intermediate layer is in direct contact with the base body.

13. An electrical component according to claim 12, wherein the intermediate layer has a thickness which is at the most 5 μm thick.

14. An electrical component, comprising:

a base body of a ceramic material, the base body having two contact regions connected to terminal elements, the ceramic material of the base body determining the electrical properties of the electrical component;

an intermediate layer directly arranged on the base body and contact regions; and a protective layer directly arranged on the intermediate layer;

the intermediate layer consisting of a material selected from the group consisting of fluoropolymer and polyether.

15. The component according to claim 14, wherein the protective layer comprises epoxy resin, silicone or urethane.

16. An electrical component, comprising:

a base body of a ceramic material, the base body having two contact regions connected to terminal elements, the ceramic material of the base body determining the electrical properties of the electrical component;

an intermediate layer directly arranged on the base body and contact regions; and a protective layer directly arranged on the intermediate layer;

the intermediate layer comprising a material selected from the group consisting of fluoropolymer and polyether and being free of epoxy resin.

17. An electrical component according to claim 1, wherein the ceramic material of the base body comprises a thermistor material.

18. An electrical component according to claim 17, wherein the thermistor material comprises a polycrystalline ceramic of a spinel type.

19. An electrical component, comprising:

a base body of a ceramic material, said base body having two contact regions connected to terminal elements;

an intermediate layer with a wax-like consistency covering said base body and contact regions; and a protective layer on the intermediate layer, the intermediate layer having an interface with the protective layer, the intermediate layer consisting of a material selected from the group consisting of fluoropolymer and polyether and the protective layer containing an organic constituent, and wherein the intermediate layer is in direct contact with the base body.

* * * * *